US006394773B1

(12) United States Patent
Shampoe et al.

(10) Patent No.: US 6,394,773 B1
(45) Date of Patent: May 28, 2002

(54) PUMP FOR CONCENTRATE PACKAGES

(75) Inventors: Marty L. Shampoe, Edinboro; Brett R. Niggel, Corry, both of PA (US); Mark A. Smith, Westerville; Gregg S. Montgomery, West Chester, both of OH (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/766,400

(22) Filed: Jan. 19, 2001

(51) Int. Cl.[7] ..... F04B 53/12
(52) U.S. Cl. ..... 417/550
(58) Field of Search ..... 417/550, 552, 417/553, 555.1

(56) References Cited

U.S. PATENT DOCUMENTS

| | | | | | |
|---|---|---|---|---|---|
| 665,145 | A | | 1/1901 | Stumpf | |
| 1,196,920 | A | | 9/1916 | Astrom | |
| 3,583,605 | A | * | 6/1971 | Corsette | 222/321.9 |
| 3,816,029 | A | | 6/1974 | Bowen et al. | |
| 4,018,545 | A | | 4/1977 | Knedlik | |
| 4,708,266 | A | * | 11/1987 | Rudick | 222/105 |
| 4,966,306 | A | * | 10/1990 | Credle et al. | 141/362 |
| 5,243,897 | A | | 9/1993 | Walton et al. | |
| 5,348,192 | A | | 9/1994 | Sardynski et al. | |
| 5,348,454 | A | | 9/1994 | Murphy | |
| 5,381,926 | A | | 1/1995 | Credle, Jr. et al. | |
| 5,494,194 | A | * | 2/1996 | Topper et al. | 222/146.6 |
| 5,603,432 | A | | 2/1997 | Sardynski et al. | |
| 5,615,801 | A | | 4/1997 | Schroeder et al. | |
| 5,618,169 | A | * | 4/1997 | Smith | 417/554 |
| 5,676,277 | A | * | 10/1997 | Ophardt | 222/181.1 |
| 5,688,113 | A | | 11/1997 | Bareiss et al. | |
| 5,730,324 | A | * | 3/1998 | Shannon et al. | 222/129.1 |
| 5,797,519 | A | * | 8/1998 | Schroeder et al. | 222/129.1 |
| 5,860,798 | A | * | 1/1999 | Tschopp | 417/439 |
| 6,045,006 | A | * | 4/2000 | Frazier et al. | 222/105 |
| 6,065,947 | A | * | 5/2000 | Wu | 417/526 |
| 6,193,109 | B1 | | 2/2001 | Credle, Jr. et al. | |
| 6,273,690 | B1 | * | 8/2001 | Fischer et al. | 417/553 |

* cited by examiner

*Primary Examiner*—Teresa Walberg
*Assistant Examiner*—Vinod D Patel
(74) *Attorney, Agent, or Firm*—Sutherland Asbill & Brennan LLP

(57) ABSTRACT

A pump for delivering product from a product package to a nozzle. The pump may include a housing with a first port, a second port, and an interior. The first port mates with the product package and the second port mates with the nozzle. A first check valve may be positioned within the first port. A piston rod may be positioned within the interior of the housing for movement therein. The piston rod may include a first piston and a second piston. The first piston may include a second check valve positioned therein such that the product is forced past the first check valve on a down stroke of the piston rod and forced past the second check valve on an up stroke of the piston rod.

24 Claims, 4 Drawing Sheets

PUMP FOR CONCENTRATE PACKAGES

TECHNICAL FIELD

The present invention relates generally to a fluid pump and more particularly relates to a fluid concentrate pump for use in disposable concentrate packages.

BACKGROUND OF THE INVENTION

Post mix juice dispensers generally include a disposable concentrate container, a concentrate pump, and a dispensing nozzle. Known dispensers generally positioned the concentrate pump within the dispenser itself. Due to the requirements of cleaning and servicing the pump, however, that portion of the pump that contacts the concentrate later became part of the disposable concentrate package itself. In use, the operator removes the exhausted concentrate container, replaces it with a new or a different container, and then proceeds to dispense the beverage. No cleaning of the pump or the dispenser generally is required.

Although these known dispensers are in widespread use, there are several perceived drawbacks with the existing designs. For example, the components used in these "disposable" containers and pumps may be relatively expensive. As such, it may be cost prohibitive to produce the pumps and containers on a large scale even if these components may be easy to use.

Further, the pulsation produced in some of these known devices may be objectionable to certain consumers. Specifically, the sound produced by a pulsating pump may be annoying. More importantly, these pumps may not produce a consistent beverage in that the pumps may tend to deliver the concentrate in pulses or lumps of material. This lumping may prevent adequate mixing of the concentrate and the water or other liquid. This inadequate mixing may result in a beverage with an off taste.

What is needed, therefore, is a pump that provides a consistently smooth flow of concentrate. This smooth flow must be provided in a disposable pump and container that is reasonably priced and compatible with existing dispensing equipment.

SUMMARY OF THE INVENTION

The present invention thus provides a pump for delivering product from a product package to a nozzle. The pump may include a housing with a first port, a second port, and an interior. The first port mates with the product package and the second port mates with the nozzle. A first check valve may be positioned within the first port. A piston rod may be positioned within the interior of the housing for movement therein. The piston rod may include a first piston and a second piston. The first piston may include a second check valve positioned therein such that the product is forced past the first check valve on a down stroke of the piston rod and forced past the second check valve on an up stroke of the piston rod.

Specific embodiments of the present invention may include the housing having an upper housing and a lower housing. The housing and the piston rod may be made out of a thermoplastic material in an injection molding process. The housing further may include a third port for delivering a liquid. The third port may be positioned between the first piston and the second piston. The pistons each may have an O-ring positioned thereon for contact with the housing. The piston rod may move a distance of about 0.175 to about 0.325 inches (about 0.444 to 0.825 centimeters) within the housing, with about 0.25 inches (about 0.635 centimeters) preferred. The piston rod may cycle within the housing about three to six times a second.

The first check valve and the first piston may define a first cavity within the housing. The first cavity may include a volume of about 3.5 to about 6.5 milliliters. The first cavity may include a vacuum of about 0.7 to about 3.0 atmospheres when the first piston moves away from the first check valve. The first piston and the second piston may define a second cavity within the housing. The second cavity may be in communication with the second port. The second cavity may include a volume of about 1.75 to about 3.25 milliliters. The first check valve and the second check valve may have an opening pressure of about 2 to about 8 pounds per square inch (about 140.6 to 562.4 gf/cm$^2$).

A further embodiment of the present invention may provide a pump for delivering product from a product package. The pump may include a housing with a first valve in communication with the product package and a piston rod positioned within the housing for movement therein. The piston rod may include a first piston and a second piston. The first piston may include a second valve therein such that the product is forced past the first check valve on a down stroke of the piston rod and forced past the second valve on an up stroke of the piston rod. The first chamber may include a volume of product of about twice the volume of the second chamber. The housing may include a nozzle port. The nozzle port may be positioned between the first and the second piston such that product is forced out of the nozzle port on both the down stroke and the up stroke of the piston rod.

The method of the present invention provides for delivering product with a pump from a product source to a nozzle. The pump may include a first valve and a piston rod with a first piston and a second piston. The first piston may include a second valve such that the first valve and the first piston define a first chamber and the second valve and the second piston define a second chamber. The method may include the steps of moving the piston rod in a downward direction, creating a vacuum in the first chamber so as to force the product from the product source through the first valve and into the first chamber, moving the piston rod in an upward direction, and compressing the product in the first chamber so as to force the product through the second valve and into the second chamber.

The method may further include the steps of moving the piston rod in the downward direction, creating a vacuum in the first chamber so as to force the product through the first valve and into the first chamber, and forcing an amount of the product in the second chamber into the nozzle. About 1.75 to 3.25 milliliters of the product may be forced into the nozzle during the down stroke. The method also may include the steps of moving the piston rod in the upward direction, compressing the product in the first chamber so as to force the product through the second valve and into the second chamber, and forcing an amount of the product in the second chamber into the nozzle. About 1.75 to about 3.25 milliliters of the product also may be forced into the nozzle during the up stroke.

Other objects, features, and advantages of the present invention will become apparent upon review of the following detailed description of the preferred embodiments of the invention when taken in conjunction with the drawings and the appended claims.

BRIEF DESCRIPTION OF THE DRAWINGS

FIG. 3 is an exploded view of the disposable concentrate package of FIG. 1.

DETAILED DESCRIPTION OF THE INVENTION

Figure 2:
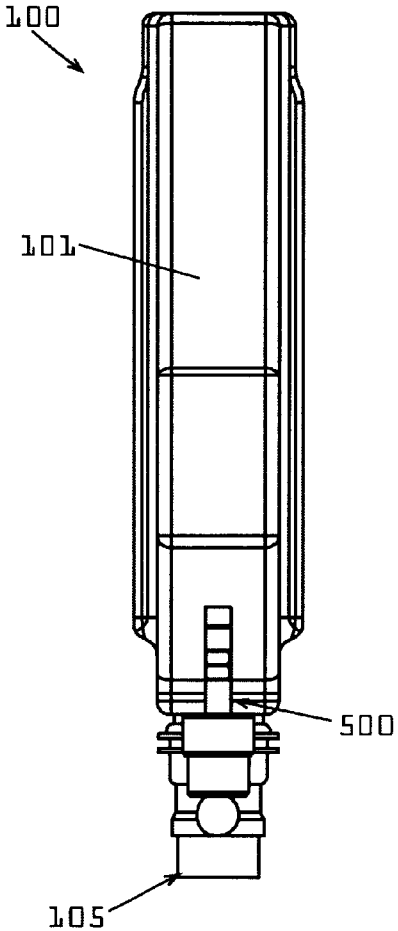
FIG. 2 is a front plan view of the disposable concentrate package of FIG. 1.
Figure 1:
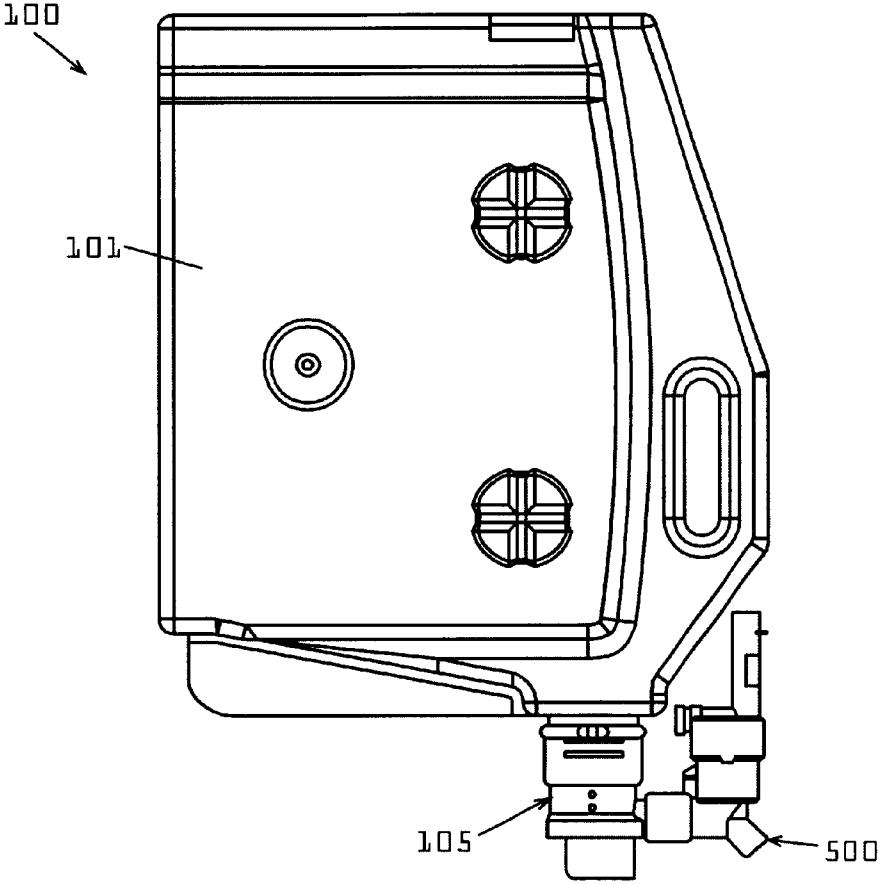
FIG. 1 is a side plan view of the disposable concentrate package of the present invention.
Figure 1:
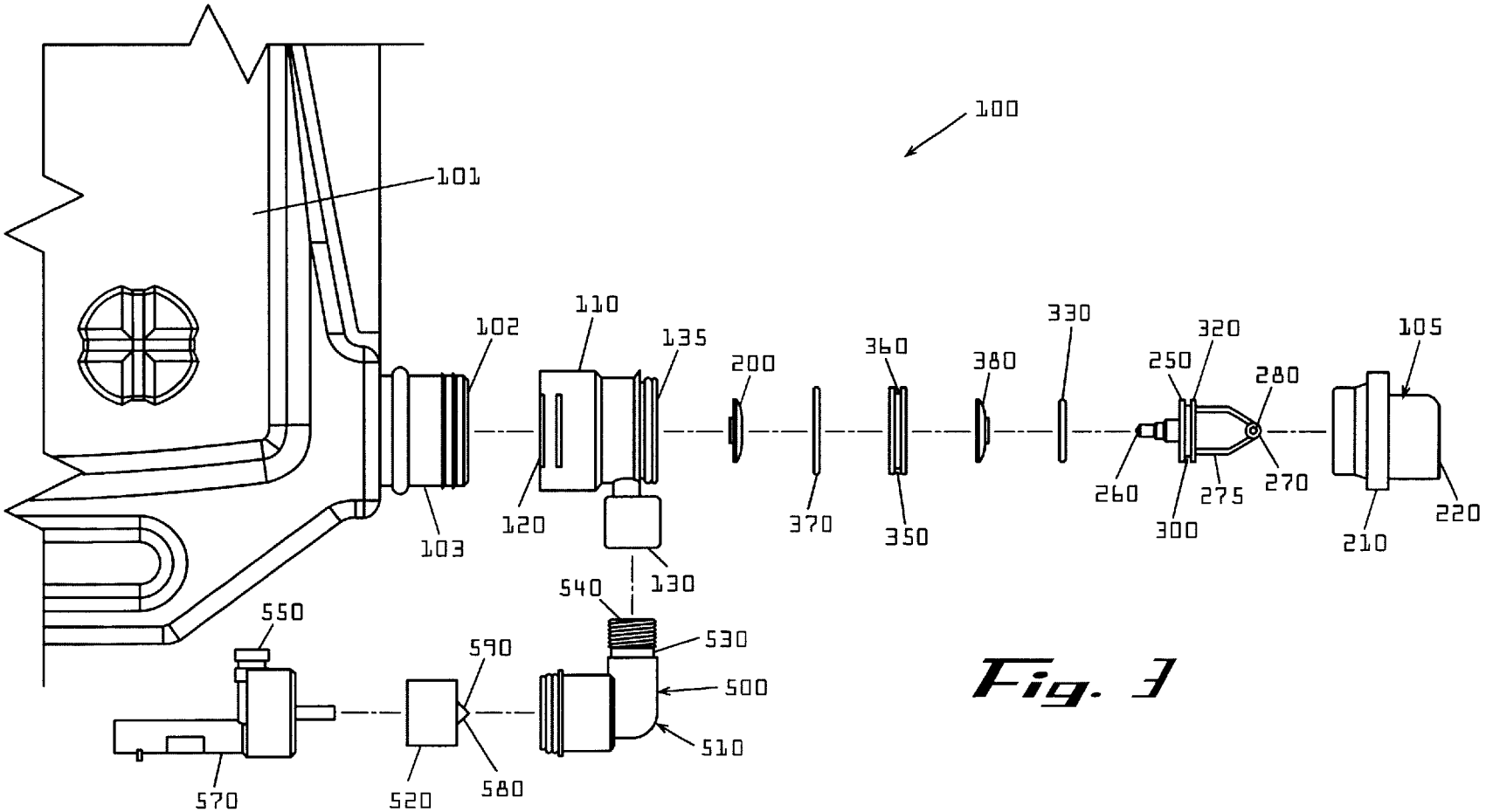
Figure 4:
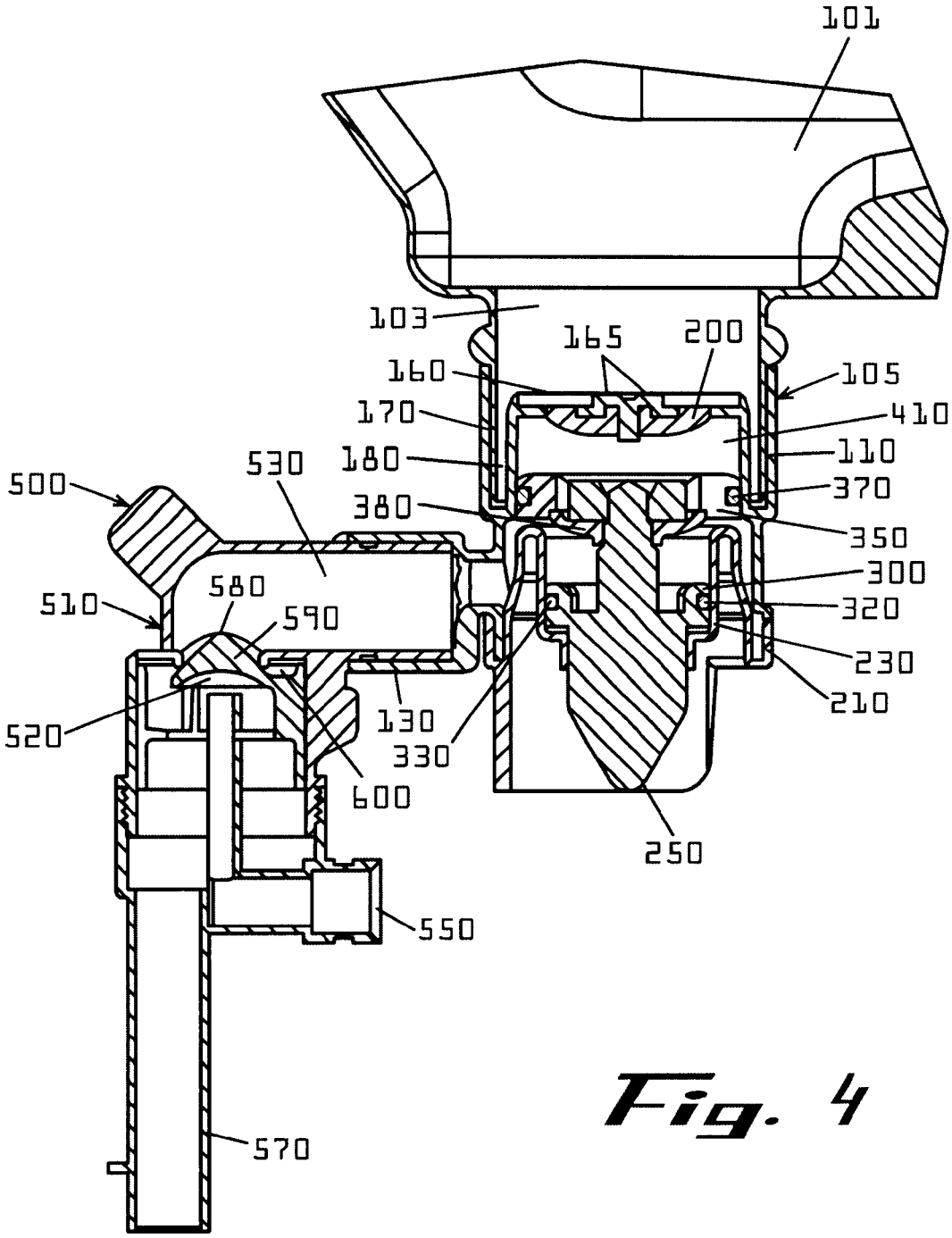
FIG. 4 is a side cross-section view of the pump of FIG. 1 with the piston rod in the down position.
Figure 5:
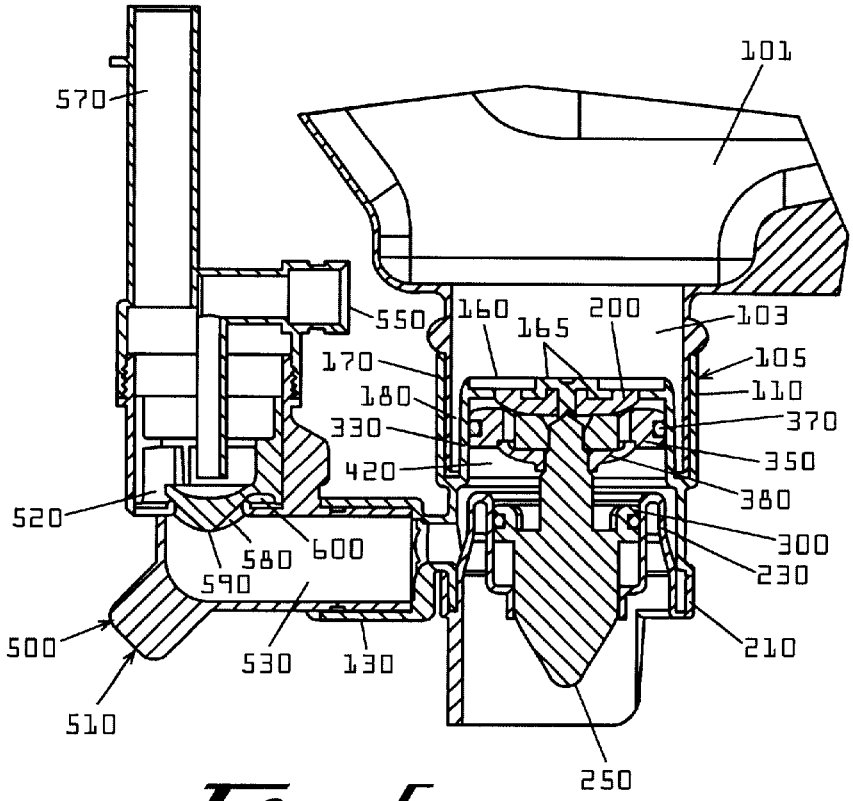
FIG. 5 is a side cross-section view of the pump of FIG. 1 with the piston rod in the up position.

Referring now to the drawings, in which like numerals indicate like elements through the several views, FIGS. 1–5 show a disposable concentrate package 100 of the present invention. The disposable concentrate package 100 as a whole is intended to be secured within a dispenser (not shown). The dispenser may be of conventional design. The disposable concentrate package 100 may include a concentrate bottle 101. The concentrate bottle 101 may be of conventional design and may be made out of conventional thermoplastics or similar materials. The bottle 101 may include an aperture 102 defined by a neck portion 103. The neck portion 103 may be threaded. In addition to the bottle 101, other types of packages may be used to hold the concentrate or other types of liquid or products. For example, a "form/fill/seal" pouch, a bag-in-box style package, or any similar type of container may be used for the bottle 101.

The concentrate package 100 may include a pump 105 connected to the bottle 101. The pump 105 may include an upper housing 110. The upper housing 110 may be a substantially tubular structure with a bottle port 120, a nozzle port 130, and a lower housing aperture 135 formed therein. The bottle port 120 may be sized to accommodate the neck portion 103 of the concentrate bottle 101. The nozzle port 130 may be sized to accommodate a mixing nozzle as described in more detail below. The lower housing aperture 135 may be sized to accommodate a lower housing as described in more detail below. Both the bottle port 120 and the nozzle port 130 may have one or more threads thereon so as to secure the pump 105 to the bottle 101 and the mixing nozzle. The upper housing 110 may be made out of a high-density polyethylene or a similar material. Other acceptable materials may include polypropylene, engineering resins, co-extrusions, and similar types of materials. The upper housing 110 may be made in an injection molding process or by similar manufacturing processes.

The bottle port 120 may form an upper chamber 150 that defines an upper vent 160. The upper vent 160 may include a series of apertures 165 molded into the upper housing 110. The bottle port 120 also may form a bottle support 170. The bottle support 170 and the upper chamber 150 are spaced apart by sufficient distance so as to accommodate the neck 103 of the bottle 101. This space between the upper chamber 150 and the bottle support 170 may define a bottle aperture 180.

Positioned within the upper vent 160 of the upper chamber 150 may be an upper check valve 200. The upper check valve 200 may be a conventional one-way valve. Specifically, an umbrella-style check valve may be used. Other types of valve designs that may be used include a flapper valve, a duck bill valve, and similar designs. The upper check valve 200 may be made of a two-part liquid silicon. Variations on the design of the check valve 200 and the materials used therein may be employed to accommodate various viscosities, particulates, and product compatibilities. Other materials that may be used include rubber, santoprene, viton, EPDM, nitrile, butyl, and similar materials. The upper check valve 200 may be joined to the upper vent 160 via ultrasonic welding or by similar types of fastening means.

The upper housing 110 may be joined with a lower housing 210 via the lower housing aperture 135. The lower housing 210 also may be a substantially tubular structure. The lower housing 210 may have a circular lower end 220 and a piston support 230 for an upper end. The piston support 230 may be a circular structure and may be open on both ends. The lower housing 210 and the upper housing 110 may be joined by threads, by a snap fit, or by other conventional types of connection means. As with the upper housing 110, the lower housing 210 may be made out of a high-density polyethylene or similar types of materials. The lower housing 210 also may be made in an injection molding process or by similar manufacturing processes.

Positioned within the lower housing 210 for movement therein may be a piston rod 250. The piston rod 250 may have a first end 260, a second end 270, and a middle portion 275. The first end 260 of the piston rod 250 may have a connector 280 so as to connect the piston rod 250 to a standard drive mechanism (not shown) of a dispenser for movement therewith. The piston rod 250 may be made from a high-density polyethylene, other types of thermoplastics, or from similar types of materials.

The middle portion 275 of the piston rod 250 may include a lower piston 300 positioned thereon. The lower piston 300 may be a substantially circular structure designed to fit within the lower housing 210. The lower piston 300 and the piston rod 250 may fill and seal the width of the lower housing 210. The lower piston 300 may be made from a high-density polyethylene, other types of thermoplastics, or from similar types of materials.

The periphery of the lower piston 300 may define an O-ring aperture 320. A standard O-ring 330 may be positioned within the aperture 320. The O-ring 330 may be made out of EPDM (ethylene-propylene-diene-monomer) or similar types of materials. The O-ring 330 may be compressed by about 0.005 to about 0.007 inches (about 0.127 to 0.178 millimeters) against the interior of the lower housing 210 to provide an adequate seal. Alternatively, an elastomeric material may be co-injected into the lower piston 300.

Positioned about the first end 260 of the piston rod 250 may be an upper piston 350. The upper piston rod 350 also may be made from a high-density polyethylene, other types of thermoplastics, or from similar types of materials. The upper piston 350 also includes an O-ring aperture 360 and an O-ring 370 positioned thereon as described above. Unlike the lower piston 300, the upper piston 350 may be substantially hollow such that a lower check valve 380 may be positioned therein. The lower check valve 380 may be similar in design and materials to the upper check valve 200. The lower check valve 380 may be joined to the upper piston 350 via ultrasonic welding or by similar types of fastening means.

The piston rod 250 and the pistons 300, 350 may be capable of moving a fixed distance within the upper housing 110 and the lower housing 210. The piston rod 250 and the pistons 300, 350 define a series of cavities within the chamber 150 of the upper housing 110 and the piston support 230 of the lower housing 210. Specifically, these elements may enclose (1) an upper cavity 410 that is defined as the space between the upper check valve 200 and the upper piston 350 and (2) a lower cavity 420 that is defined as the space between the upper check valve 380 and the upper piston 350 and the lower piston 300 and the piston support 230. The upper cavity 410 is in communication with the bottle 101 via the upper check valve 380. The lower cavity 420 is in communication with the upper cavity 410 via the lower check valve 200. The lower cavity 420 also is in communication with the nozzle port 130. The upper cavity 410 may hold about 3.5 to about 6.5 milliliters of product while the lower cavity 420 may hold only about 1.75 to about 3.25 milliliters. The upper cavity 410 may thus be about twice as large in volume as the lower cavity 420.

The concentrate package 100 also may have a mixing nozzle 500 connected to the pump 105. The mixing nozzle 500 may be similar to that used and described in commonly owned U.S. Pat. No. 5,615,801 to Schroeder, et al. U.S. Pat. No. 5,615,801 is incorporated herein by reference. As is shown, the mixing nozzle 500 may include a nozzle housing 510 rotatably connected to the pump 105. The nozzle housing 510 may enclose a mixing chamber 520. A concentrate passageway 530 may lead from a concentrate inlet opening 540 to a concentrate inlet port 550 and into the mixing chamber 520. The housing 510 also may include a water inlet opening 550 and a water passageway 560 leading from the water inlet opening 550 into the mixing chamber 520. The housing 510 also may include a beverage discharge spout 570. The mixing chamber 520 may include a mixing element 580, which also may act as a shut-off valve.

The incoming concentrate from the pump 105 is forced to spread out around a conical surface 590 and enter the mixing chamber 520 through a narrow annular slot 600. The concentrate is then hit and sheared by the water that is directed against the concave bottom of the element 580. The mixed beverage then exists the mixing nozzle 500 via the discharge spout 570.

The mixing nozzle 500 preferably can rotate about its connection to the bottle 101 so that the nozzle 500 can be rotated up during shipping and handling. The concentrate package 100 as a whole thus takes up less room and prevents damage to its pump components. The nozzle 500 can be rotated down just prior to insertion into a dispenser and use.

In use, the pump 105 is attached to the bottle 101 or to a similar type of product reservoir. The pump 105 is preferably attached to the bottle 101 by means of an airtight and product tight seal. Specifically, the bottle 101 is inserted into the bottle port 120 of the pump 105. The connector 280 of the piston rod 250 is then secured into a drive mechanism of the dispenser (not shown). Likewise, a water line or secondary product line may be attached to the mixing nozzle 500.

When the dispenser drive mechanism is activated, the piston rod 250 is forced to move in a vertical plane for a fixed distance. The piston rod 250 then reverses direction to the original starting point. This fixed distance may be about 0.175 to 0.325 inches (about 0.444 to 0.825 centimeters) with about 0.25 inches (about 0.635 centimeters) preferred. The fixed distance may vary with the nature and properties of the concentrate or product to be dispensed. The piston rod 250 may rotate about 3–6 times per second. Likewise, the number of rotations may depend upon the nature and properties of the products used therein. The lower piston 300 and the upper piston 350, being fixedly attached to the piston rod 250, move in unison with the piston rod 250.

The product itself is in position on top of the upper check valve 200 such that the product exerts a force upon the valve 200 at all times. The check valve 200 is thus preloaded such that a relatively small amount of force is needed to open the check valve 200. For example, about 2.0 to about 8.0 pounds per square inch (about 140.6 to 562.4 gf/cm$^2$) may be required to open the check valve 200. As the upper piston 350 moves away from the upper check valve 200, a vacuum is formed within the upper cavity 410. As the vacuum exceeds the force required to open the upper check valve 200, product from the bottle 101 is allowed to enter the upper cavity 410 through the check valve 200. A fixed amount of product thus fills the upper cavity 410. Once the piston rod 250 reaches the lowest point of the drive cycle, the vacuum above the upper piston 350 is depleted. The upper check valve 200 then closes and product ceases to enter from the bottle 101.

As the piston rod 250 starts to travel back towards the upper check valve 200, the product within the upper cavity 410 becomes compressed. This compression causes pressure to build within the upper cavity 410. Once this pressure exceeds the opening force of the lower check valve 380, the check valve 380 opens and product is forced into the lower cavity 420. About 2.0 to about 8.0 pounds per square inch (about 140.6 to 562.4 gf/cm$^2$) also may be required to open the lower check valve 380.

As the piston rod 250 reverses and moves downward, some of the product in the lower cavity 320 is forced out of the nozzle port 130 as the lower cavity 420 is reduced in size. Likewise, another vacuum forms in the upper cavity 410, thus forcing further product into the upper cavity 410. As the piston rod 250 again reverses direction and the upper piston 350 heads towards the upper check valve 200, the upper cavity 410 is again compressed, thus forcing product out of the upper cavity 410, through the lower check valve 380, and into the lower cavity 420. This rush of new product through the check valve 380 also forces more of the product already in the lower cavity 420 or passing through the lower check valve 380 out of the nozzle port 130. The mixing nozzle 500 then mixes the concentrate or other product with water or another fluid as described above so as to mix the desired beverage.

The pump 105 thus delivers product on both the up and down strokes of the piston rod 250. For example, about 1.75 to about 3.25 milliliters of product may be delivered on the down stroke and the up stoke. In total, the pump 105 may deliver about one gram or about three ounces per second. This delivery of product on both strokes of the piston rod 250 thus provides a smooth flow of product to the mixing nozzle 500. This smooth flow thus avoids the problem of pulsation and the delivery of lumps of material.

Figure 6:
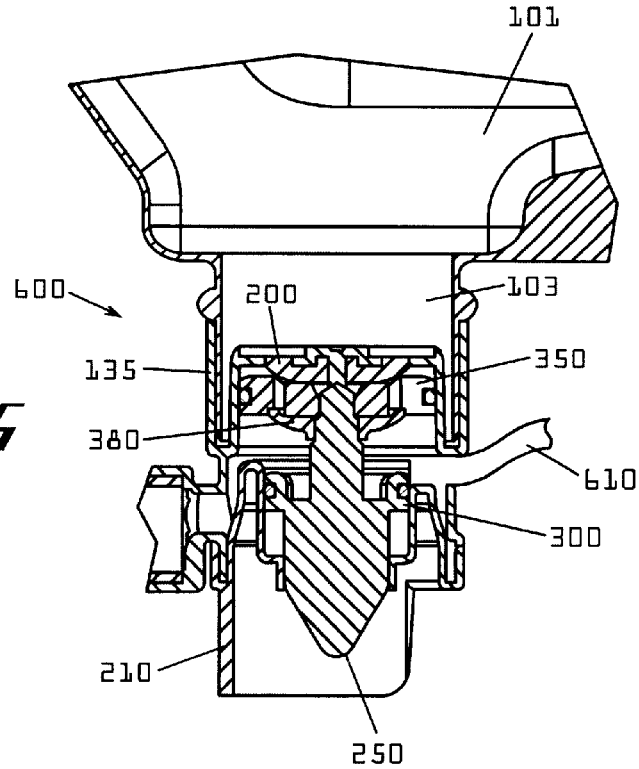
FIG. 6 is a side cross-section view of the pump of an alternative embodiment of the present invention with the piston rod in the down position.

FIG. 6 shows a further embodiment of the present invention, a pump 600. The pump 600 provides for the internal mixing of product and water or product and a second fluid. Internal mixing of product may be preferred or more efficient for low viscosity products while the external mixing method described above may be preferred for high viscosity products. The pump 600 has a liquid inlet opening 610 positioned between the lowest point of the upper piston 350 and the highest point of the lower piston 300. Water or any other type of liquid may be regulated into the pump 600 by means of a solenoid valve (not shown) or by other types of mechanical or electrical means.

As the water or other liquid enters the lower cavity 420, the product is forced into the lower cavity 420 from the reservoir. As the water is entering under a static pressure from a water supply source, the water causes turbulence. This turbulence can be amplified by means of baffles (not shown) or by other interruptions in the flow path of the water and the product. The turbulence causes the two mediums to mix and become homogeneous. To achieve proper mixing and desired mixture ratios, water should only enter the pump 600 during movement of the piston rod 250.

The present invention thus results in a pump 105, 600 that provides a smooth flow of concentrate or product over a wide range of product characteristics. Further, because most of the components of the pump 105, 600 are made out of thermoplastics in an injection molding process, the pump 105, 600 as a whole is relatively inexpensive to mass produce. Further, the pump 105, 605 maintains the ease of use consistent with known devices. Although the compatibility of the materials within the concentrate package 100 with the products to be pumped should be considered, the pump 105, 600 may be used with a wide variety of liquids of various viscosities, temperatures, and other properties.

It should be apparent that the foregoing relates only to the preferred embodiments of the present invention and that numerous changes and modifications may be made herein without departing from the spirit and scope of the invention as defined by the following claims.

We claim:

1. A pump for delivering product from a product package to a nozzle, comprising:

a housing;

said housing comprising a first port, a second port, and an interior such that said first port mates with said product package and said second port mates with said nozzle;

a first check valve positioned within said first port of said housing;

a piston rod positioned within said interior of said housing for movement therein;

said piston rod comprising a first piston and a second piston positioned thereon; and said first piston comprising a second check valve positioned therein such that said product is forced past said first check valve on a down stroke of said piston rod and forced past said second check valve on an up stroke of said piston rod.

2. The pump of claim 1, wherein said housing comprises an upper housing and a lower housing.

3. The pump of claim 1, wherein said housing comprises a thermoplastic.

4. The pump of claim 1, wherein said housing comprises an injection molding process.

5. The pump of claim 1, wherein said piston rod comprises a thermoplastic.

6. The pump of claim 1, wherein said first piston and said second piston each comprise an O-ring positioned thereon for contact with said housing.

7. The pump of claim 1, wherein said piston rod moves a distance of about 0.175 to about 0.325 inches within said housing.

8. The pump of claim 1, wherein said piston rod may cycle within said housing about three to six times a second.

9. The pump of claim 1, wherein said first check valve and said first piston define a first cavity within said housing.

10. The pump of claim 9, wherein said first cavity comprises a volume of about 3.5 to about 6.5 milliliters.

11. The pump of claim 9, wherein said first cavity comprises a vacuum of about 0.7 to about 3.0 atmospheres when said first piston moves away from said first check valve.

12. The pump of claim 9, wherein said first piston and said second piston define a second cavity within said housing.

13. The pump of claim 12, wherein said second cavity is in communication with said second port.

14. The pump of claim 12, wherein said second cavity comprises a volume of about 1.75 to about 3.25 milliliters.

15. The pump of claim 1, wherein said first check valve and said second check valve comprise an opening pressure of about 2.0 to 8.0 pounds per square inch.

16. The pump of claim 1, wherein said housing further comprises a third port for delivering a liquid, said third port positioned between said first piston and said second piston.

17. A pump for delivering product from a product package, comprising:

a housing;

said housing comprising a first valve in communication with said product package; and a piston rod positioned within said housing for movement therein;

said piston rod comprising a first piston and a second piston; and said first piston comprising a second valve therein such that said product is forced past said first check valve on a down stroke of said piston rod and forced past said second valve on an up stroke of said piston rod.

18. The pump of claim 17, wherein said first chamber comprises a volume of about twice a volume of said second chamber.

19. The pump of claim 17, wherein said housing comprises a nozzle port, said nozzle port positioned between said first and said second piston such that product is forced out of said nozzle port on both said down stroke and said up stroke.

20. A method for delivering product from a product source to a nozzle with a pump, said pump comprising an first valve and a piston rod with a first piston and a second piston, said first piston comprising a second valve, such that said first valve and said first piston define a first chamber and said second valve and said second piston define a second chamber, said method comprising the steps of:

moving said piston rod in a downward direction;

creating a vacuum in said first chamber so as to force said product from said product source through said first valve and into said first chamber;

moving said piston rod in an upward direction; and compressing said product in said first chamber so as to force said product through said second valve and into said second chamber.

21. The method of claim 20, further comprising the steps of:

moving said piston rod in said downward direction;

creating a vacuum in said first chamber so as to force said product through said first valve and into said first chamber; and forcing an amount of said product in said second chamber into said nozzle.

22. The method of claim 20, wherein about 1.75 to 3.25 milliliters of said product may be forced into said nozzle during said down stroke.

23. The method of claim 21, further comprising the steps of:

moving said piston rod in said upward direction;

compressing said product in said first chamber so as to force said product through said second valve and into said second chamber; and forcing an amount of said product in said second chamber into said nozzle.

24. The method of claim 23, wherein about 1.75 to 3.25 milliliters of said product may be forced into said nozzle during said upstroke.

* * * * *